United States Patent [19]

Huffman

[11] 4,250,716

[45] Feb. 17, 1981

[54] AUXILIARY REFRIGERATION SYSTEM UTILIZING ATMOSPHERIC AIR

[76] Inventor: Howard E. Huffman, P.O. Box 137, Clinton, Mich. 49236

[21] Appl. No.: 42,119

[22] Filed: May 24, 1979

Related U.S. Application Data

[63] Continuation of Ser. No. 854,249, Nov. 23, 1977, abandoned.

[51] Int. Cl.[3] ..... F25D 17/00

[52] U.S. Cl. ..... 62/180; 62/203; 62/332; 62/409; 62/412; 165/16; 236/49

[58] Field of Search ..... 62/180, 203, 208, 326, 62/332, 409–412, 457, 235; 165/16; 236/49

[56] References Cited

U.S. PATENT DOCUMENTS

| | | | |
|---|---|---|---|
| 1,053,443 | 2/1913 | Scott | 62/235 |
| 1,600,522 | 9/1926 | Strehlke | 62/408 |
| 1,693,200 | 11/1928 | Flint | 62/326 |
| 2,067,959 | 1/1937 | Wasson | 236/49 |
| 2,216,873 | 10/1940 | Browne | 62/412 |
| 2,407,036 | 9/1946 | Snavely | 165/16 |
| 2,855,839 | 10/1948 | Teigen | 98/33 A |
| 3,659,432 | 5/1972 | Selhost | 62/412 |
| 4,006,606 | 2/1977 | Underdue | 62/457 |
| 4,023,947 | 5/1977 | Ferry | 165/16 |

*Primary Examiner*—Ronald C. Capossela
*Attorney, Agent, or Firm*—Beaman & Beaman

[57] ABSTRACT

Apparatus for use with refrigerators, particularly of the walk-in cooler type, wherein, when available, low temperature atmospheric air is drawn into the cooler for cooling purposes, rather than utilizing the usual compressor type refrigeration system. The apparatus is mounted within the space to be cooled and utilizes temperature sensing means for automatic operation, and in an embodiment, employs an electric storage battery which would permit extended operation in the event of a power failure.

8 Claims, 2 Drawing Figures

AUXILIARY REFRIGERATION SYSTEM UTILIZING ATMOSPHERIC AIR

This is a continuation of application Ser. No. 854,249, filed Nov. 23, 1977, now abandoned.

BACKGROUND OF THE INVENTION

The invention pertains to auxiliary means for maintaining refrigerators at cooling temperatures utilizing ambient air.

Refrigerators, walk-in coolers, refrigerator display cases, and similar apparatus used in the preservation of food utilize refrigeration circuits operated by electrically driven compressors. As the power requirement for most commercial refrigeration devices is more than one horsepower, the energy utilized annually is significant, even though it is only desired to cool the controlled space to 40° F. or the like.

In the northern climates the atmospheric temperatures are often 40° F. or less during significant portions of the year, and yet, conventional refrigeration apparatus used in such climates, even during the coldest days, employs the usual compressor driven refrigeration circuit to maintain the desired cooling temperature.

Cool atmospheric temperatures have been utilized for food refrigeration purposes for many years, but in the past fifty years, the economical availability of electrical energy, and the close temperature control achievable in a cooled space with conventional refrigeration equipment under automatic control, has not encouraged the use of atmospheric air for refrigeration purposes. In view of the present need for energy conservation and due to increased energy costs, operators of large refrigeration equipment are interested in reducing their operating expenses, yet apparatus of a practical nature which would permit cool atmospheric air to be employed for refrigeration purposes has not heretofore been available.

The use of atmospheric air to cool refrigerated spaces has been long practiced, a typical installation being shown in U.S. Pat. No. 1,693,200, and it is also known to draw atmospheric air into a refrigerated space by the utilization of a fan as shown in U.S. Pat. No. 1,600,522. Also, in the air conditioning of buildings atmospheric air is often mixed with refrigerated air in the control of temperature and humidity, as typfied in U.S. Pat. Nos. 2,407,036 and 3,659,432. However, none of the known prior art can be readily utilized with refrigeration apparatus for achieving fully automatic operation, which is concise in construction, dependable in operation, and does not require modification to the existing compressor-operated refrigeration apparatus.

BRIEF DESCRIPTION OF THE INVENTION

It is an object of the invention to provide auxiliary refrigeration apparatus for use in cooling refrigerated spaces utilizing cool atmospheric air wherein the energy consumption is significantly lower than that required if compressor driven refrigeration maintained the desired temperature.

A further object of the invention is to provide auxiliary refrigeration apparatus for use with existing refrigerated spaces which does not require modification to the apparatus other than forming an opening to permit the entrance of atmospheric air.

An additional object of the invention is to provide auxiliary refrigeration apparatus comprising a preassembled unit which may be readily installed requiring a minimum of skill, which accurately senses the temperature of the cooled space, and will not permit atmospheric air to enter the cooled space unless the ambient temperature is below a predetermined value.

Another object of the invention is to provide auxiliary refrigeration apparatus utilizing an electric storage battery power source wherein atmospheric air may be utilized for cooling purposes even though the main electric energy source has been interrupted thereby preventing food spoilage, such apparatus utilizing an automatically controlled battery charger and low voltage system.

In the practice of the invention the auxiliary apparatus is located within a sheet metal housing mounted within the space to be cooled, such as a walk-in cooler. The unit is usually mounted adjacent one of the insulated walls, and an opening formed in the insulated wall establishes communication with atmospheric air. An electrically driven fan within the housing communicates with the atmospheric air inlet, and the fan discharges into the cooled space. Electric temperature sensing means within the housing senses the temperature within the cooled space, and the temperature of the atmospheric air being drawn into the fan. Thus, upon the need for cooling, if the atmospheric air temperature is below a predetermined value, such as 30° F., the fan is energized and draws atmospheric air into the cooler until the temperature within the cooled space is lowered to the desired level as sensed by the cooler space thermostat which will de-energize the fan until the need for further cooling arises.

Preferably, the housing includes an air channel through which the cooled space air is circulated by an electrically driven fan, and the temperature thereof is sensed by the thermostat control determining the need for operation of the auxiliary refrigeration apparatus. In this manner, circulation of air within the cooled space can be economically accomplished by means of a fractional horsepower fan, and accurate temperature sensing of the cooled space is achieved.

In an embodiment of the invention low voltage fan motors are utilized directly drawing their power from an electric storage battery within the apparatus housing. The housing also includes a battery charger, and charger control means, such as a timer, whereby the battery capacity can be maintained at a high level. In the battery driven embodiment the fan providing circulation of air within the cooler usually operates intermittently with the operation of the atmospheric air intake fan.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
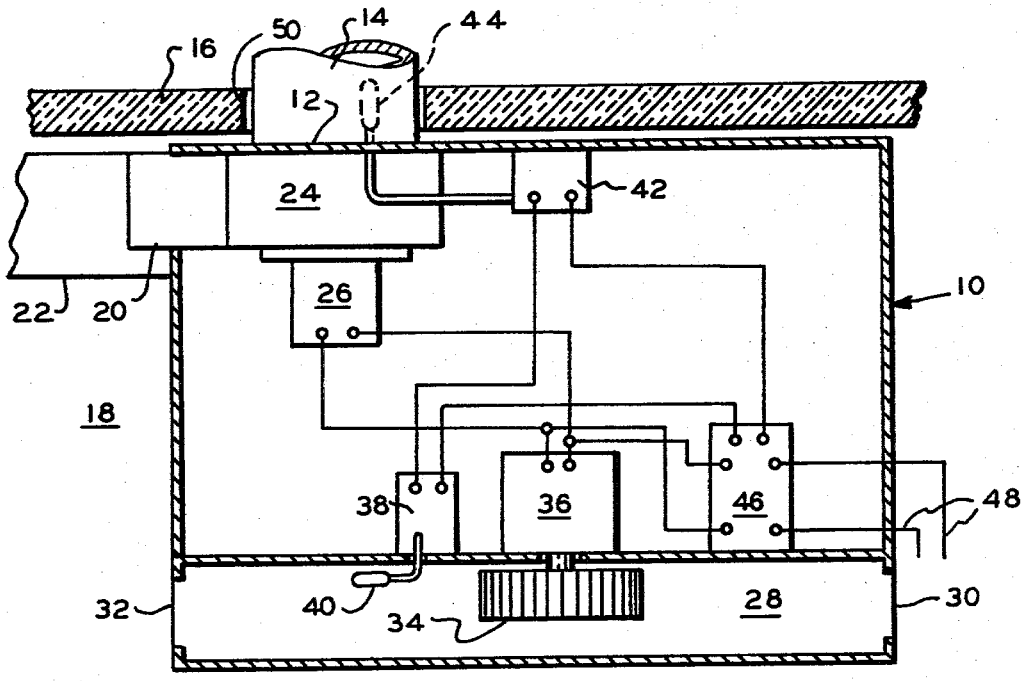
FIG. 1 is a top plan sectional view of auxiliary refrigeration apparatus in accord with the invention with the top cover removed.

With reference to FIG. 1, auxiliary refrigeration apparatus in accord with the invention includes a sheet metal housing 10 which may be of a generally rectangular configuration and includes removable covers and panels for access purposes, not shown. The housing includes an atmospheric air inlet 12 of circular configuration in communication with a cylindrical conduit 14 which passes through the insulated wall 16 of the space being cooled, generally indicated at 18, such as a walk-in food cooler, or the like.

The housing 10 also includes an atmospheric air outlet 20, and the outlet may communicate with a conduit 22 in which filter, humidifying, or dehumidifying apparatus of conventional construction, not shown, may be located. In its simplest form, the outlet 22 would be in direct communication with the space 18, and may include a grill or louvers for directing the air being discharged through the outlet in a desired direction.

Atmospheric air is drawn into the housing 10 by means of the fan 24 having an inlet communicating with housing inlet 12, and the fan is provided with a discharge in communication with the housing outlet 20. The fan 24 may be of any conventional type, such as of the "squirrel cage" type, and is powered by an electric motor 26 coaxial with the fan impeller.

The housing 10 may also include an air channel or passage 28, defined by sheet metal components, and it will be appreciated that the air channel includes an entrance opening 30 and an exit opening 32, both in direct communication with the space 18. A fan impeller 34 within channel 28 is rotated by electric motor 36, and the impeller and fan construction is such as to produce a flow of cooled air through the channel to the left as viewed in FIG. 1. The discharge of the air through the exit opening 32 will cause an internal circulation of air within the space 18, and, preferably, the fan 34 is continually energized in order to prevent stratification of the air within the cooled space 18, and as the motor 36 is of fractional horsepower the energy consumption is light.

A thermostatically operated switch 38 is mounted within housing 10 and includes a temperature sensing bulb 40 located within the air channel 28. Thus, the switch 38 will accurately sense the air temperature within the cooled space 18 as it passes through the channel.

In a similar manner, a thermostatic switch 42 mounted within housing 10 includes a temperature sensing bulb 44 located within the atmospheric air inlet 12 for sensing the atmospheric air and the temperature of the air entering the fan 24.

The fan motors 26 and 36, and thermostatic switches 38 and 42 are interconnected by electric conductors, schematically illustrated, and the control means for these components may include a relay generally indicated at 46 which may include a step-down transformer such that 110 volt AC supply conductors 48 connected to the relay result in a 24 volt output, as well as a 110 volt output. The motors 26 and 36 may be 110 volt AC energized, while the thermostatic switches 38 and 42 may be 24 volt controlled, as is common with thermostatic switches, and the mode of wiring the illustrated components is not shown in detail as the same is within the scope of one skilled in the art desiring the mode of operation described below.

The auxiliary refrigeration apparatus described above is sold as a pre-packaged unit, basically consisting of the housing 10 having the described components assembled therein, and pre-wired. The installer need only form an opening 50 in the cooler wall 16 to permit installation of conduit 14 which communicates with the atmospheric air. Preferably, the outer end of the conduit 14 will be provided with a rain cap, screen or filter to prevent entrance of foreign matter. Once the conduit 14 is installed the apparatus is connected to the available 110 volt AC power supply by conductors 48. It is important to note that in the installation of the apparatus of the invention that no modification is required of the existing refrigeration controls for the cooled space 18 which control the conventional compressor driven refrigeration system. To utilize the auxiliary apparatus it is only necessary to set the conventional cooled space thermostatic control at a temperature which will energize the compressor driven refrigeration apparatus should the auxiliary apparatus not be capable of producing the desired cooling temperature.

The thermostatic switch 38 is set to open and close at the temperature limits desired within the cooled space 18, and the thermostatic switch 42 is set to close at a predetermined minimum atmospheric temperature, usually about 30° F. Thus, upon the outside temperature air being cold enough to close switch 42 the fan motor 26 will be energized in accordance with the operation of thermostatic switch 38 and cycle on and off to maintain the desired temperature within space 18 by sole means of cool atmospheric air.

Should the atmospheric air temperature rise above the necessary minimum, the switch 42 will not close and fan motor 26 will not energize even though switch 38 closes. In such event the thermostatic control on the compressor driven refrigeration apparatus will be energized as the temperature within space 18 reaches the temperature operating limits of the compressor driven control circuit and the temperature maintained within space 18 will solely be by the conventional compressor driven apparatus. Accordingly, it will be appreciated that the operating cycle of the auxiliary apparatus of the invention will normally be at slightly lower temperatures than the operating cycle of the compressor driven apparatus.

Preferably, the fan motor 36 will be continually energized to produce a continuous flow through the air channel 28 assuring exposure of the bulb 40 to the temperature of space 18, and the continuous air flow also has the advantage of minimizing stratification of air temperatures within the cooled space. The air channel 28 is provided with an opening and exit of sufficient dimension to permit bulb 40 to be exposed to the temperature of space 18 even when fan 34 is not energized in order to assure auxiliary refrigeration operation should fan 34 become inoperative. In fact, it is within the scope of the invention to eliminate fan 34 from the apparatus, as well as eliminate air channel 28, wherein bulb 40 would be mounted upon the exterior of the housing 10, and such modification to the apparatus would not change the described operation except with respect to the operation of fan 34.

In some installations it will be necessary that the conduit 14 be relatively long, and of such length that the location of the bulb 44 adjacent the inlet 12 will not produce a true sensing of the atmospheric temperature. In such event, the bulb 44 could be extended in length to the exterior inlet of the conduit 14, or the control circuit and switch 42 can be modified to always energize fan motor 26 upon the need for cooling being sensed by switch 38, and if the air being drawn into fan 24 is not of the required minimum temperature as sensed by bulb 44 after several seconds of operation the switch 42 would open and immediately cease operation of fan 24.

Figure 2:
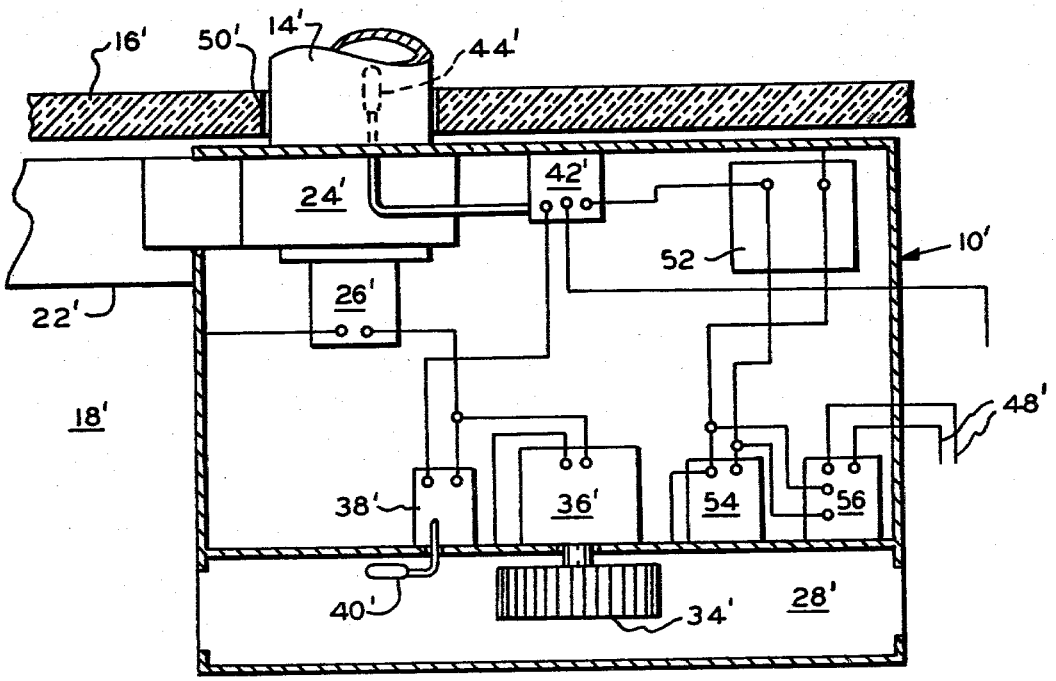
FIG. 2 is a top plan sectional view of an embodiment of auxiliary refrigeration apparatus in accord with the invention utilizing storage battery power.

A variation of auxiliary refrigeration apparatus in accord with the invention is shown in FIG. 2 wherein similar components to those previously described are indicated by primed reference numerals.

In the embodiment of FIG. 2 the housing 10' includes an electric rechargeable storage battery 52 of 12 volts DC, a battery charger 54, and a control 56 for the battery charger. In this embodiment the fan motors 26' and 36' are of the 12 volt variety, as are the thermostatic switches 38' and 42'.

The operation of the embodiment of FIG. 2 is identical to the embodiment previously described above except that the power source for the fan motors is the battery 52. Thus, in the event of a power failure of the 110 volt electrical supply energizing the battery charger control 56, the auxiliary apparatus will continue to function for many hours under battery operation and until the battery is depleted.

In normal operation, the charger 54 will regularly charge the battery 52, and the mode of charging is controlled by charger control 56. Control 56 may constitute a timer which energizes the charger for a predetermined duration each day, or the control 56 may be such as to automatically sense the condition of battery 52 and produce charging in accordance with the condition of the battery. The control 56 is supplied with 110 volt AC through conductors 48', and this embodiment of the apparatus, as that previously described, is not connected to the compressor driven refrigeration control circuit for the cooled space 18'.

In the embodiment of FIG. 2, because of the battery operation, it is preferable that the fan 34' only operate during the time that the fan 24' is functioning in order to prevent excessive battery drain. However, as the motor 36' is of low horsepower it is feasible to permit continuous operation of fan 34', if desired.

As the auxiliary refrigeration apparatus of the invention utilizes cool atmospheric air, and handles such air with fractional horsepower fans, the energy required to operate the apparatus is small and considerable energy cost savings are experienced. As the apparatus in no way interferes with the functioning of the compressor driven equipment failure of the auxiliary apparatus to operate, or an atmospheric temperature above that necessary to cool, does not endanger the food being cooled within space 18, and installation of the auxiliary apparatus can be readily achieved by installers of ordinary skill.

It is appreciated that various modifications to the inventive concept may be apparent to those skilled in the art without departing from the spirit and scope of the invention.

I claim:

1. A unitized auxiliary refrigeration system utilizing atmospheric air for coolers having thermally insulated walls defining a cooled space and cooled by a primary refrigeration system comprising, in a combination, a rectangular housing adapted to be mounted within the space to be cooled having an end wall and sidewalls, an atmospheric air inlet defined in one of said housing walls, an atmospheric air outlet defined in another wall of said housing, a fan within said housing having an inlet port communicating with said atmospheric air inlet and an outlet port communicating with said atmospheric air outlet, an electric motor drivingly connected to said fan, first electric temperature sensing means mounted upon said housing sensing the temperature of the air within the space to be cooled, second electric temperature sensing means sensing the atmospheric air temperature, control means upon said housing electrically connected to said motor and first and second temperature sensing means adapted to energize said motor upon said first sensing means indicating the need for cooling and said second sensing means sensing a predetermined atmospheric temperature, and electric power supply means supplying said control means.

2. In an auxiliary refrigeration system as in claim 1, said first temperature sensing means including a first sensing bulb and said second temperature sensing means being mounted within said housing and including a second sensing bulb located within said housing atmospheric air inlet.

3. In an auxiliary refrigeration system as in claim 1 wherein said control means includes a transformer having a low voltage output and a relay, said power supply means comprising 110 volt AC supplying the input to said transformer, said temperature sensing means operating on said low voltage from said transformer.

4. In an auxiliary refrigeration system as in claim 1, wherein said control means includes a rechargable battery within said housing, a battery charger within said housing connected to said battery, and battery charger control means within said housing controlling operation of said charger, said power supply means being connected to said battery charger control means.

5. In an auxiliary refrigeration system as in claim 4 wherein said battery charger control means comprises a timer.

6. In an auxiliary refrigeration system as in claim 1, said housing including an air channel having an entrance and an exit in communication with the space to be cooled, a second electric fan within said air channel for moving air therethrough, said first temperature sensing means sensing the temperature within said air channel, said control means being electrically connected to said second fan.

7. In an auxiliary refrigeration system as in claim 6, said first temperature sensing means including a bulb, said bulb being located within said air channel.

8. In an auxiliary refrigeration system as in claim 7, said control means constantly energizing said second electric fan.

* * * * *